United States Patent [19]

O'Connell, Jr.

[11] Patent Number: 5,018,621

[45] Date of Patent: May 28, 1991

[54] CYLINDRICAL CONTAINER AND DISPENSER FOR SPHERICAL OBJECTS

[76] Inventor: John J. O'Connell, Jr., 97 E. Waters Rd., Red Creek, N.Y. 13143

[21] Appl. No.: 509,355

[22] Filed: Apr. 16, 1990

[51] Int. Cl.[5] ..... B65D 81/04; B65D 81/26; B65D 85/58

[52] U.S. Cl. ..... 206/204; 206/523; 206/535; 206/814; 215/231; 215/DIG. 3

[58] Field of Search ..... 206/204, 445, 528, 540, 206/535-537, 591, 814, 523; 215/231, DIG. 3; 220/212

[56] References Cited

U.S. PATENT DOCUMENTS

| | | | |
|---|---|---|---|
| 567,488 | 9/1896 | Moehn | 215/231 |
| 1,050,706 | 1/1913 | Taylor | 206/204 |
| 2,758,737 | 8/1956 | Hennings | 215/231 |
| 2,767,864 | 10/1956 | Van Litsenburg | 215/231 |
| 3,768,636 | 10/1973 | O'Connell, Jr. | 215/231 |
| 3,826,358 | 7/1974 | Butler et al. | 206/204 |
| 4,782,941 | 11/1988 | Freise | 215/231 |
| 4,805,789 | 2/1989 | Lancesseur et al. | 206/540 |
| 4,842,153 | 6/1989 | Hulon | 206/523 |

FOREIGN PATENT DOCUMENTS

| | | | |
|---|---|---|---|
| 0823016 | 9/1969 | Canada | 215/231 |
| 0112605 | 12/1968 | Denmark | 206/537 |
| 1152053 | 7/1963 | Fed. Rep. of Germany | 215/231 |
| 1193867 | 5/1965 | Fed. Rep. of Germany | 215/231 |
| 0781263 | 5/1960 | France | 215/231 |
| 0562398 | 5/1957 | Italy | 215/231 |

*Primary Examiner*—Jimmy G. Foster

*Attorney, Agent, or Firm*—Robert J. Bird

[57] ABSTRACT

A resilient cylindrical tubular container for spherical objects such as medicinal pills, includes a stopper with flexible fingers extending into the tube to restrain the objects from movement during shipment. An adsorbent desiccant cushion in the bottom of the tube cushions the objects and keeps them dry. Objects are dispensed by removing the cap, pressing the tube at a point below the number of objects desired, and then inverting the tube to pour out only that number.

2 Claims, 1 Drawing Sheet

CYLINDRICAL CONTAINER AND DISPENSER FOR SPHERICAL OBJECTS

BACKGROUND INFORMATION

This invention relates to a dispensing container for spherical objects, such as medicine in the form of spherical pills.

U.S. Pat. No. 3,768,636 was issued to me on Oct. 30, 1973. It discloses a resilient cylindrical tubular container for spherical pills. The pills are of a diameter slightly smaller than the tube so they can be poured from it. A stopper has flexible fingers extending into the tube to restrain the pills from movement during shipment. The pills are dispensed by removing the cap, pressing the tube at a point below the number of pills desired, and then inverting the tube to pour out only the desired pills. The compression of the tube forms a barrier against discharge of the remaining pills. The present invention is an improvement of that device described in U.S. Pat. No. 3,768,636. The specification of U.S. Pat. No. 3,768,636 is hereby incorporated by reference in this specification.

SUMMARY OF THE INVENTION

In summary, the invention is a resilient cylindrical tubular container for spherical objects, such as pills. A stopper at the top end includes flexible fingers extending into the tube to restrain the objects from movement during shipment. An adsorbent desiccant cushion in the bottom of the tube cushions the objects and keeps them dry. Objects are dispensed by removing the cap, pressing the tube at a point below the number of objects desired, and then inverting the tube to pour out only that number.

DRAWING

DESCRIPTION

Figure 1:
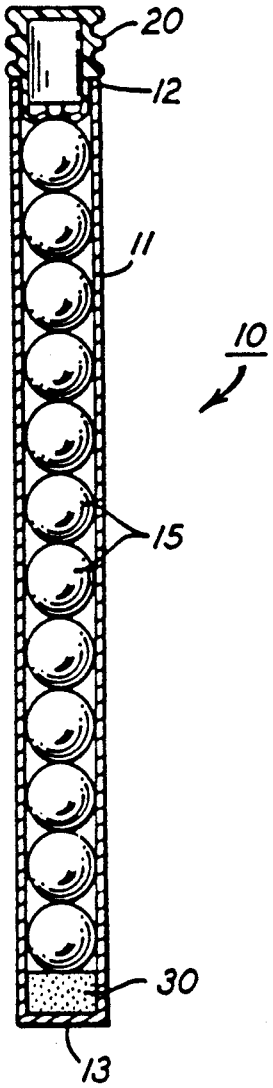
FIG. 1 is a sectional elevation view of the container of this invention.
Figure 2:
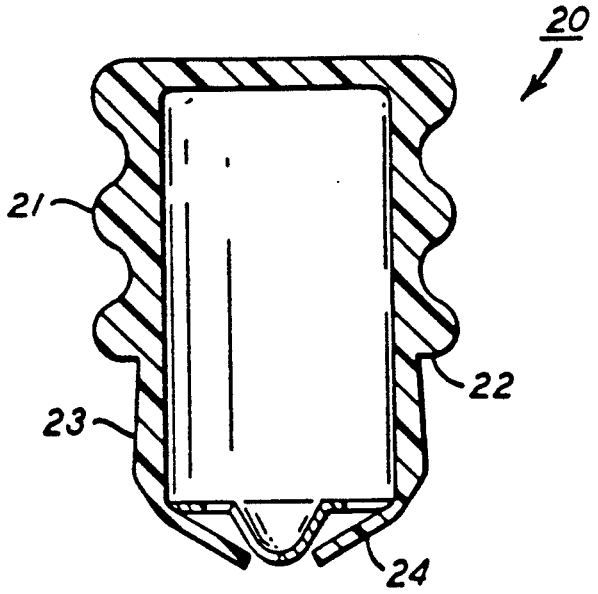
FIG. 2 is an enlarged sectional view of the stopper from FIG. 1.
Figure 3:
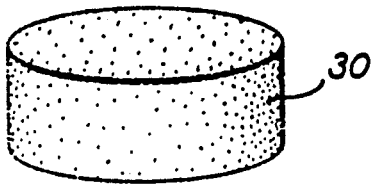
FIG. 3 is an enlarged sectional view of the cushion from FIG. 1.
Figure 4:
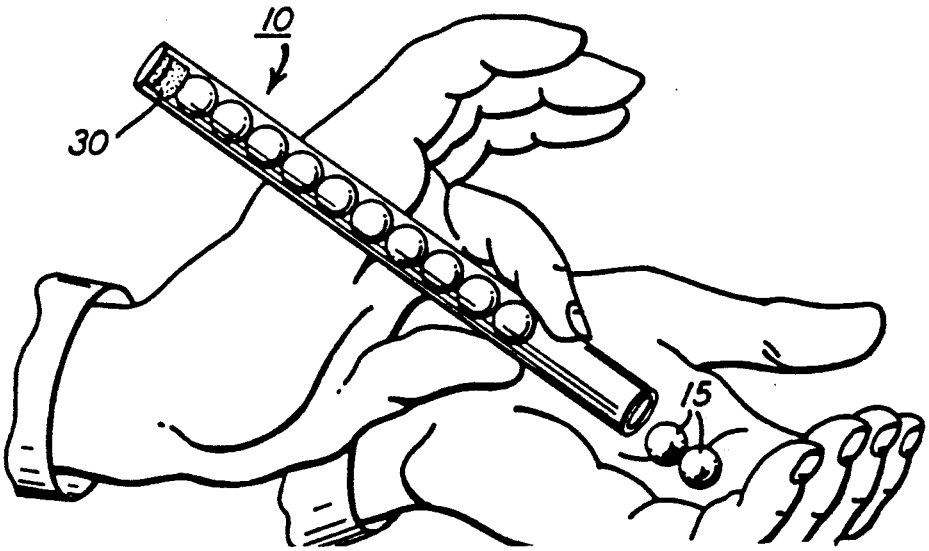
FIG. 4 illustrates the dispensing function of the container.

Referring to the drawing, the dispensing container of this invention is generally indicated at 10. The container 10 includes a cylindrical tube 11 having an open top 12 and a closed bottom 13. The tube 11 is of a transparent and moderately flexible plastic material, such as cellulose acetate to permit the tube to be compressed by a small pressure between thumb and forefinger. The container 10 holds medicine in pill form. The pills 15 are spherical, rather than the usual pillow shape.

The open top 12 of the tube receives a stopper 20 of a moldable plastic material such as polyethylene. The stopper has an upper external portion 21 which is adapted for gripping by the hand, and a slightly conically shaped lower portion 23 for insertion into the top of the container 10. The upper portion 21 and the lower portion 23 of the stopper 20 are separated by a shoulder 22 which abuts the edge of the container top 12. The stopper and container join in a substantially airtight fit. The stopper 20 further includes a plurality of resilient fingers 24 extending downward and radially inward. When the stopper is inserted in place, the fingers 24 are deformed by their contact with the topmost pill to thereby press against the pills to prevent their rolling or rattling within the tube.

A pad or cushion 30 is placed in the bottom 13 of the container. The cushion is a synthetic foam such as styrofoam, impregnated with a hygroscopic material or desiccant such as calcium chloride. The cushion cooperates with the stopper to prevent pill breakage within the container, and the desiccant keeps the pills dry.

In a practical example, there are a dozen pills in a tube four inches long. The pills are 0.370 inches outside diameter, the tube is 0.375" inside.

In the normal relaxed state of the tube 11, the pills are freely movable within the tube so they can be poured from it, but a slight manual compression of the tube prevents pill movement past the resulting tube constriction. To dispense a desired number of pills from the container, hold the tube between thumb and forefinger at a point below the number of pills desired, apply a slight squeeze or compression to the tube, then invert it to pour out only the desired pills.

The foregoing description is intended as illustrative. The container is described as a pill container, but it is not limited to that use. It may be used with other spherical objects, such as marbles or ball bearings. The concept and scope of the invention are limited only by the following claims and equivalents thereof.

What is claimed is:

1. A dispensing container for spherical objects, including:

a transparent resilient cylindrical tube having an open top and a closed bottom;

a stopper for removable insertion in the top of said container and including a plurality of resilient fingers extending downward and radially inward for contact with the topmost of said objects to thereby prevent axial movement of said objects when said tube is full thereof; and a foam cushion disposed in the bottom of said container and cooperating with said stopper to prevent object breakage within said container, said cushion impregnated with a hygroscopic material to attract moisture and to keep the same from said objects.

2. A dispensing container for pills, including:

a transparent resilient cylindrical tube having an open top and a closed bottom;

a stopper for removable insertion in the top of said container and including a plurality of resilient fingers extending downward and radially inward for contact with the topmost of said pills to thereby prevent axial movement of said pills when said tube is full thereof; and a foam cushion disposed in the bottom of said container and cooperating with said stopper to prevent pill breakage within said container, said cushion impregnated with a hygroscopic material to attract moisture and to keep the same from said pills.

* * * * *